US006018899A

United States Patent [19]

Hanitz

[11] Patent Number: 6,018,899

[45] **Date of Patent: *Feb. 1, 2000**

[54] ROTATING DISPLAY

[76] Inventor: Michael G. Hanitz, 15413 Farm Creek Dr., Woodbridge, Va. 22191

[ * ] Notice: This patent is subject to a terminal disclaimer.

[21] Appl. No.: 08/995,863

[22] Filed: Dec. 22, 1997

Related U.S. Application Data

[63] Continuation-in-part of application No. 08/616,650, Mar. 14, 1996, Pat. No. 5,628,253.

[51] Int. Cl.[7] ..... G09F 11/02

[52] U.S. Cl. ..... 40/473; 40/431

[58] Field of Search ..... 40/473, 431

[56] References Cited

U.S. PATENT DOCUMENTS

| | | | |
|---|---|---|---|
| 495,079 | 4/1893 | Williams | 446/253 X |
| 960,316 | 6/1910 | Hanlon . | |
| 1,361,911 | 12/1920 | Schwesinger, Jr. . | |
| 1,513,521 | 10/1924 | Robertson | 40/473 |
| 1,846,858 | 2/1932 | Glaser et al. | 40/431 |
| 2,034,813 | 3/1936 | Holland . | |
| 2,068,414 | 1/1937 | Johnston | 40/473 |
| 2,084,915 | 6/1937 | Leitch | 40/473 X |
| 2,134,150 | 10/1938 | Schmidt | 40/431 |
| 3,199,239 | 8/1965 | Reed . | |
| 3,373,917 | 3/1968 | Cox . | |
| 3,701,897 | 10/1972 | Pennington et al. | 40/431 X |
| 3,738,035 | 6/1973 | Bricker | 40/473 X |
| 3,749,903 | 7/1973 | Belokin, Jr. | 40/431 |
| 3,791,058 | 2/1974 | Mollica | 40/473 X |
| 3,808,721 | 5/1974 | Gersch | 40/502 X |
| 3,947,985 | 4/1976 | Skrzypczak | 40/473 |
| 3,964,190 | 6/1976 | Leo . | |
| 4,008,534 | 2/1977 | Swartz . | |
| 4,353,179 | 10/1982 | Jennings | 40/431 X |
| 4,490,932 | 1/1985 | McIntire | 40/473 |
| 4,910,898 | 3/1990 | Hector | 40/479 |
| 5,196,961 | 3/1993 | Sun . | |
| 5,205,636 | 4/1993 | Carpenter | 472/61 X |
| 5,704,145 | 1/1998 | Hanitz | 40/431 X |

*Primary Examiner*—Joanne Silbermann
*Attorney, Agent, or Firm*—Jones, Tullar & Cooper

[57] ABSTRACT

A rotating display, particularly for use as a point of purchase inducement to customers in a retail environment, includes a two-sided display panel with fluorescent printed indicia or graphics on at least one side which are illuminated by ultraviolet light. The panel is rotated about its central longitudinal axis at a rotational velocity of at least approximately 300 RPM. The spinning fluorescent indicia, when illuminated in this fashion, create the illusion of a solid through the persistence of vision.

20 Claims, 10 Drawing Sheets

ROTATING DISPLAY

CROSS REFERENCE TO RELATED APPLICATIONS

This application is a continuation-in-part of application Ser. No. 08/616,050, filed Mar. 15, 1996.

BACKGROUND OF THE INVENTION

The present invention pertains, in general, to rotatable displays which employ fluorescent indicia or designs and black lights to provide optical illusions.

There have been a number of kinetic displays which have been used as objects of dynamic art. It is known to use ultraviolet radiant energy in conjunction with such displays. Ultraviolet radiant energy has a visible light component and a component which is outside the visible spectrum. It is also known to irradiate various materials with ultraviolet light, where these materials are thereby caused to fluoresce in the visible spectrum. The light is conventionally known as "black light" and the materials are conventionally known as "fluorescent" materials.

For those who are attempting to compete in today's crowded retail environment, it is important to try to catch the eye of the customer in order to convey a message. Frequently, displays at the point of purchase can be a valuable inducement to buy. A number of commodities are packaged and displayed specifically for creating the impulse to buy in the customer.

In the prior art, displays have included devices for making noise, robotic arms for waving at the customer, flashing lights for periodically illuminating an attractive graphical image and the usual assortment of pictures with smiling young models, cuddly puppies and adorable children. This competition for the eye of the customer has created a colorful and brightly lit morass of visual stimuli which only serves to clutter the retail space. Accordingly, customers have become more jaded and now ignore most point of purchase displays in the retail space. There has been a long felt need then for a point of purchase display which does not significantly add to the distressing visual clutter impinging on the customer but which does attract the customer's attention and invites a second look, thereby getting a message across to the customer.

SUMMARY OF THE INVENTION

The present invention is directed to a rotatable display which will make a printed message or a graphical design or symbol appear to be suspended in thin air. In all embodiments of the invention, the display includes a panel which is adapted to spin on a central longitudinal axis passing along a length of the panel between a front and a back side thereof. At least one side of the panel preferably includes a message or design composed of alphabetical characters, numerals, graphical symbols or pictorial works which are printed using fluorescent materials. The display also includes an ultraviolet light (black light) which provides a continuous source of illumination for the fluorescent graphics. When the panel is rotated about its central longitudinal axis at a sufficiently high speed (e.g., 300–3000 RPM), persistence of vision renders the graphics as an illusion of a solid. Once the display is spinning, it appears that the graphics are hanging in thin air and glowing brightly. This creates a visual curiosity which attracts and delights an individual, such as a retail customer.

BRIEF DESCRIPTION OF THE DRAWINGS

The objects, features and advantages of the invention will become apparent to those of skill in the art from the following detailed description of a number of preferred embodiments thereof, taken in conjunction with the accompanying drawings, in which.

DETAILED DESCRIPTION OF THE PREFERRED EMBODIMENTS

Figure 1A:
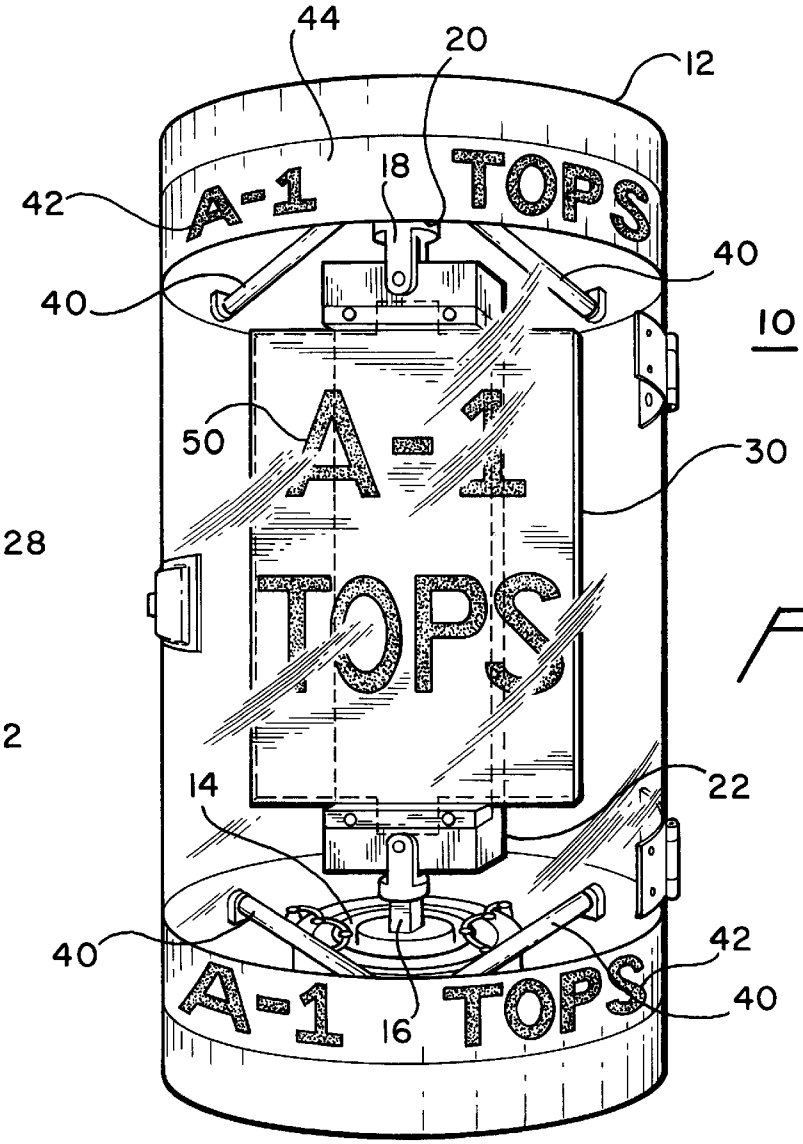
FIG. 1*a* illustrates a first embodiment of a rotating display which includes an interchangeable display panel.
Figure 1B:
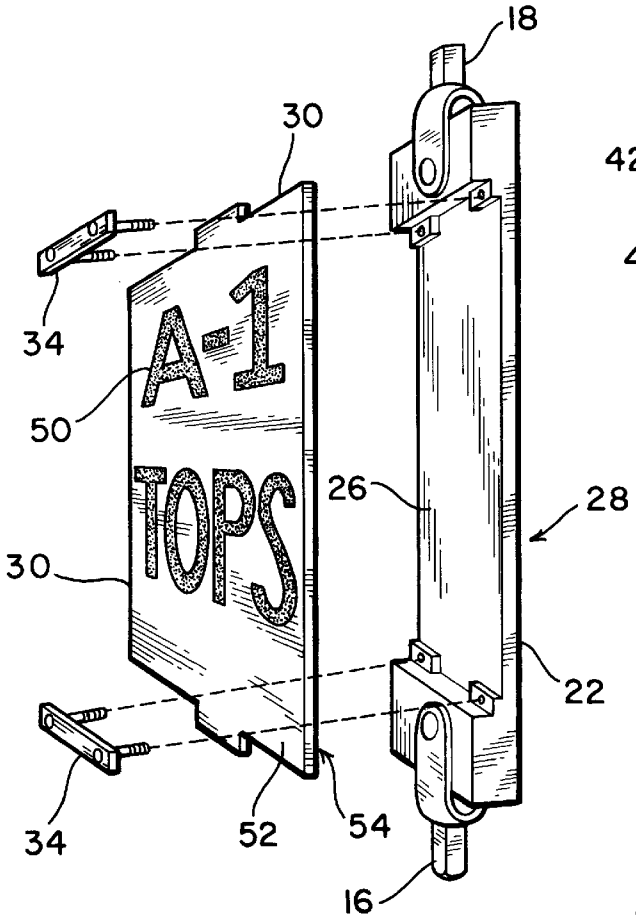
FIG. 1*b* illustrates a first fastening apparatus for the interchangeable display panel of FIG. 1*a;*

Turning now to a detailed description of a number of preferred embodiments of the present invention, FIGS. 1*a* and 1*b* illustrate a first embodiment of a rotating display 10. The display 10 preferably includes a housing 12 which may be fabricated from plexiglass, glass, acrylic or any other transparent material. In this embodiment, the housing 12 is in the shape of a cylinder, however, any suitable or attractive shape may be used. The housing 12 may have a hinged opening which permits access to the display components. Within the housing 12 is a drive motor 14. The drive motor 14 serves to rotate a lower shaft 16 at a selected speed of between approximately 300 and 3000 RPM. The actual speed may vary with the size, shape and color of the display 10, although 1500 RPM has been experimentally determined to provide a good visual effect with most embodiments. The critical factor here is that a rotational velocity must be chosen which is well suited to take advantage of the persistence of vision in the viewer's eye. A particular size, shape and color of indicia may be well suited to a rotational velocity of more or less than 1500 RPM (but still in the range of 300–3000 RPM).

An upper shaft 18 is suspended from a bearing 20 within the top of the housing and is adapted to spin freely in response to the input from the motor 14. A display panel support 22 is affixed to the upper shaft 18 and the lower shaft 16 and is rotatable about a central longitudinal (preferably vertical) axis which is coaxial with shafts 16 and 18 by the operation of motor 14. The display panel support 22 is thus rotatable through 360 degrees of rotational orientation.

The panel support 22 has a front side 26 and a back side 28. In the first preferred embodiment, a transparent detachable acrylic display panel 30 is attached to the front side of the panel support 22. The panel 30 can be attached to the panel support 22 by threaded fasteners with a bracket 34 or suitable snap-in fasteners or the like. The panel 30 may also be attached by hook and loop fasteners (not shown). With the changeable display panel 30 of the first embodiment of FIGS. 1*a* and 1*b*, a number of different advertisers' messages can be displayed using one display. Alternatively, a single advertiser can have changeable messages on different display panels.

A plurality of ultraviolet (black) lights 40 are situated within the top and bottom portions of the display housing 10. The black lights 40 may be General Electric model F4T5/BLB lamps, or the like. These are arranged about the display panel 30 in a semi-circle to provide continuous, uniform illumination of the display panel 30 over all of the panel's rotational orientations of interest. If, at a minimum, one of the lights 40 is used, then that light should be positioned in close proximity to one side of the housing 12, and the display 10 should be aimed to have that side of the housing oriented toward the viewer.

The lights 40 may also serve to back-light one or more printed indicia 42, which may be translucent or transparent and are preferably printed on the outer surface of the housing 12. These external indicia 42 stand out in relief against an opaque background region 44. Alternatively, the external indicia 42 may be opaque and the background region may be translucent.

A message comprised of fluorescent printed indicia or a fluorescent graphical design 50 is applied to a front side 52 of the transparent panel 30. An opaque masking layer 68 (see FIG. 4) is applied to a back side 54 of the transparent panel 30. The orientation of the masking layer is such that the layer precisely covers the indicia 50, thereby making the indicia 50 non-reflective when the front of the panel support 26 is rotated away from the lights 40. Another approach to locating the masking layer is to first apply the masking layer to the front side 52 of the panel 30 as an opaque, preferably flat black, base coat which is visible through the transparent panel 30, and then to apply the fluorescent indicia or design 50 over that base coat, so that the indicia or design 50 is visible from the front side 52 of the panel 30 but not from the back side 54 of the panel 30.

Figure 2:
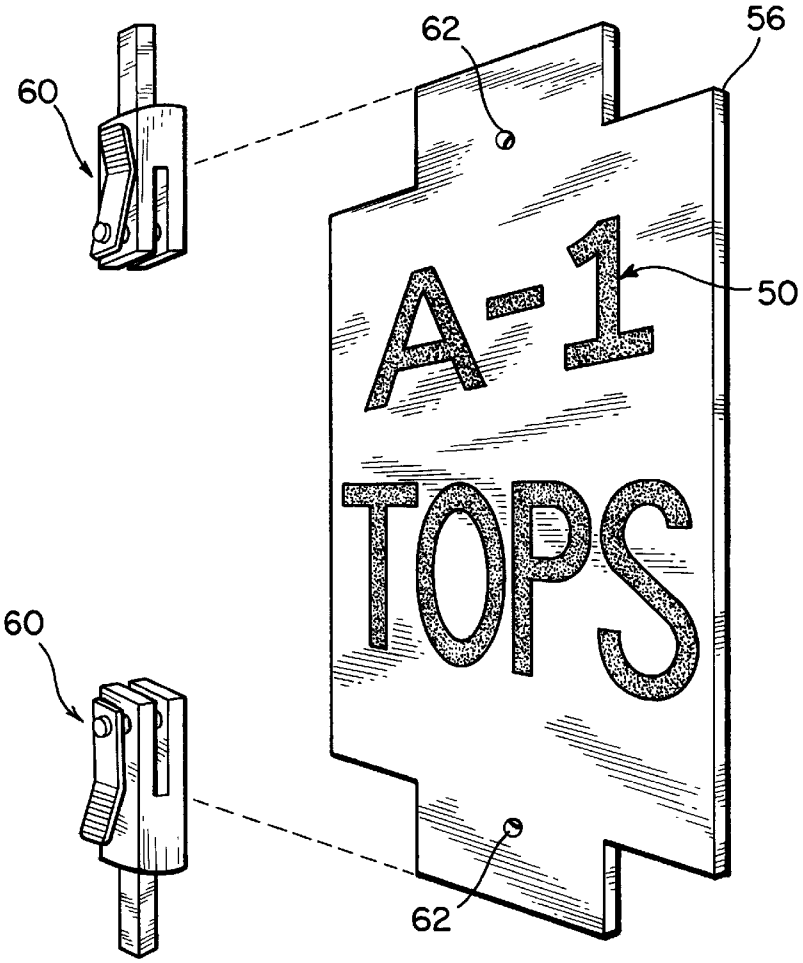
FIG. 2 illustrates another fastening arrangement for the interchangeable display panel.

Turning now to FIG. 2, a second fastening arrangement for an interchangeable transparent display panel 56 is illustrated. The display panel 56 includes a pair of clevis pins 60 which are used to secure the transparent panel 56 through a pair of matching apertures 62. This variation eliminates the separate panel support 22 of FIG. 1*b* and combines the functions of the panel support and the display panel into a unitary structure. The display panel 56 also includes the fluorescent indicia or design 50 and corresponding opaque masking layer (not shown).

Figure 3:
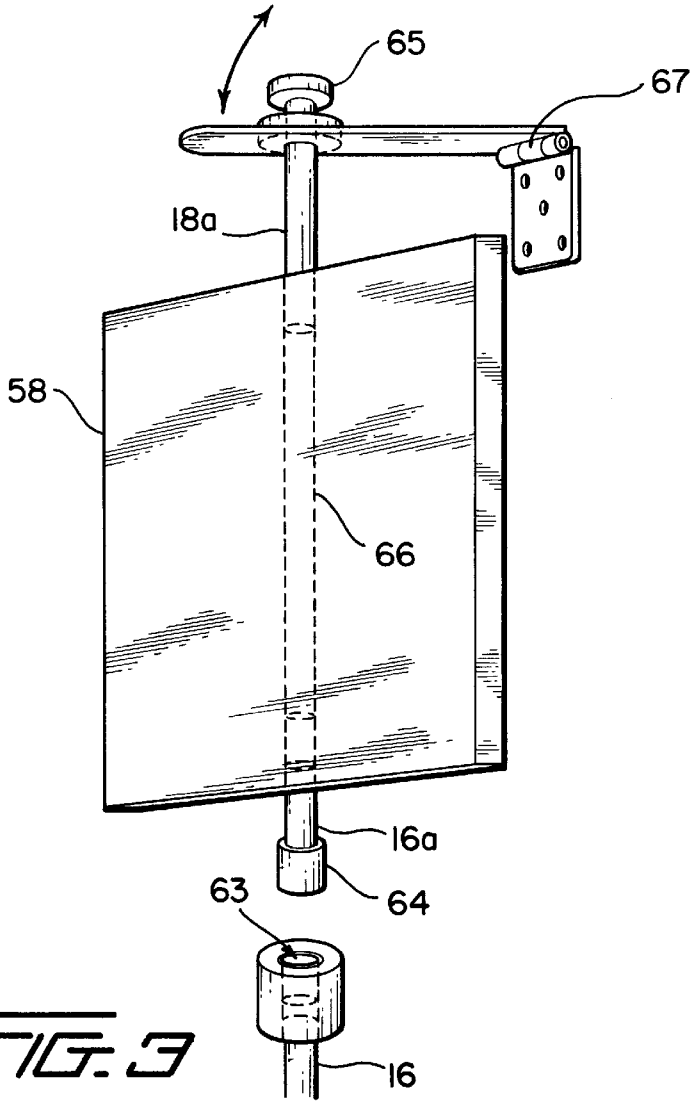
FIG. 3 illustrates yet another fastening arrangement for the interchangeable display panel.

Turning now to FIG. 3, a third fastening arrangement for an interchangeable transparent display panel 58 is illustrated. In this variation, the lower drive shaft 16 for driving the transparent panel 58 includes a coupler 63 which receives a shaft 16*a* terminated in a rubber boot 64. The rubber boot 64 fits snugly in the coupler 63 and static friction prevents the boot 64 from rotating within the coupler 63. The coupler 63 supports and drives the shaft 16*a* and is selectively separable therefrom. At the top of the display panel 58, an upper shaft 18*a* is terminated in a removable rubber cap 65 which is designed to fit within an upper coupler (not shown). The transparent display panel 58 includes a central cylindrical aperture 66 which can receive either a continuous shaft (not shown) or can be used with upper and lower shafts 18*a*, 16*a*, as shown; in either case, the shafts are fixed to the panel 58 and, when driven, rotate the panel 58 about a central longitudinal axis thereof. A hinge 67 allows selective decoupling of the panel 58, thus allowing the panel 58 to be serviced or removed.

Figure 4:
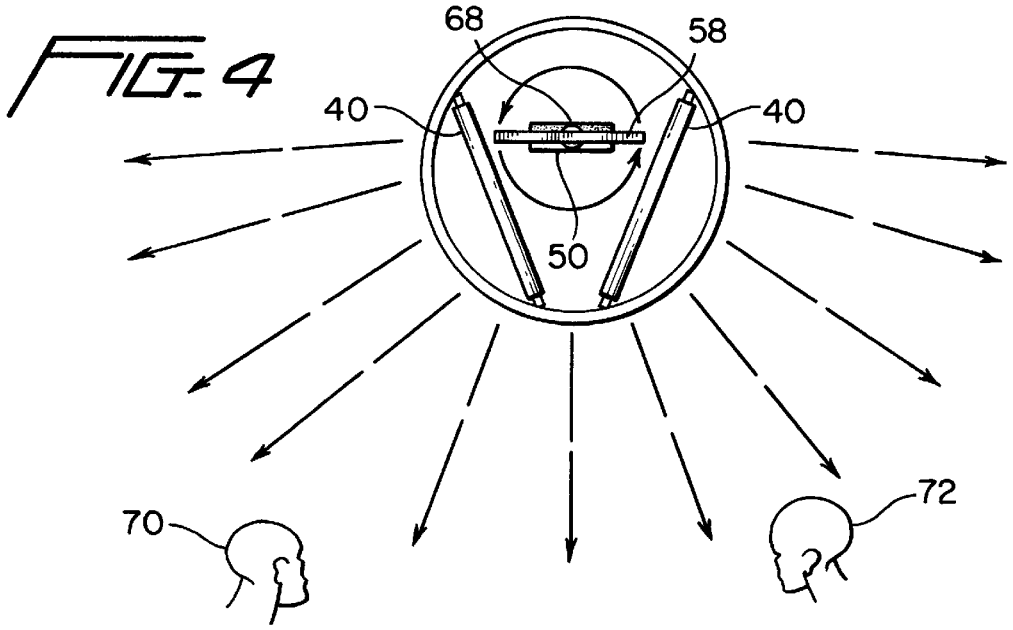
FIG. 4 is a top view of the first preferred embodiment of the rotating display showing, in section, the interior of the display.
Figures 5A, 5B, 5C:
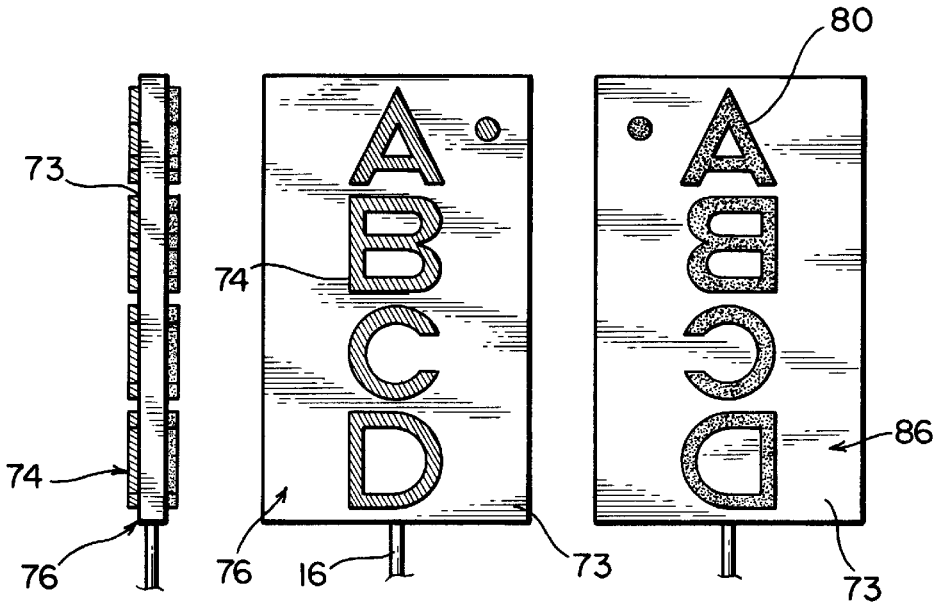
FIGS. 5*a–d* are side, front, back and top views, respectively, of another display panel which may be employed with the embodiment of FIG. 1*a;*
Figure 5D:
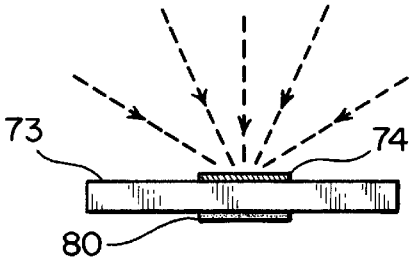

Turning now to FIG. 4, when the rotating display panel 58 is illuminated by ultraviolet lights 40, the light is reflected from the fluorescent printed indicia 50 on the front of the panel 58. Masking layers 68 are shown on the back of the transparent panel 58 and prevent a first viewer 70 from seeing the indicia 50 through the back side of the display panel 50. The first viewer 70 and a second viewer 72 are separated by an angle of azimuth, as measured from the panel 58. The two viewers 70 and 72 are within a range of azimuth angles which is defined as including all the panel's rotational orientations of interest. These orientations define an angular sweep of the panel 58 which is intended to be observed by viewers.

FIGS. 5*a–d* are four views of another variation of the present invention where the lower shaft 16 is inserted directly into a clear acrylic display panel 73. Fluorescent printed indicia 74 is printed on a front side 76 of the panel 73. Opaque, preferably flat black, mask indicia 80 are printed on a backside 86 of the panel 73.

Figure 6:
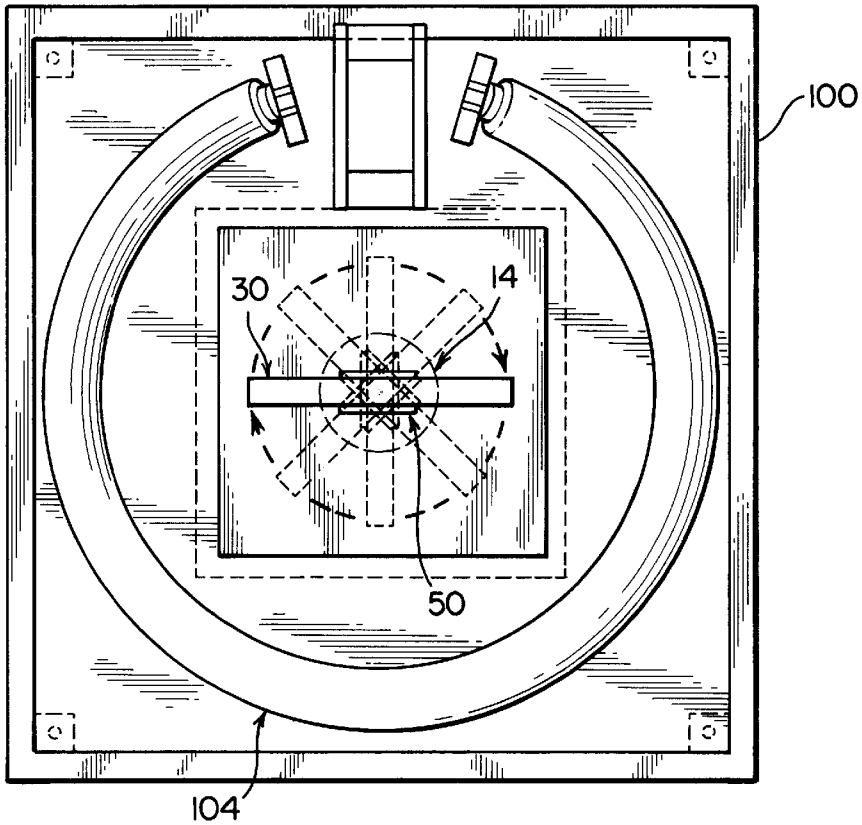
FIG. 6 is a top view of another embodiment of the rotating display.

FIG. 6 is a top view of another embodiment of the invention which includes a display enclosure 100. In this embodiment, the enclosure 100 is approximately square and a roughly circular black light 104 is used for illumination of the display panel 30. FIG. 6 is a sectional view looking from within the enclosure towards the bottom of the enclosure. Circular light 104 may be a General Electric model FCA21/BLB, or the like. The circular light 104 provides uniform illumination of the display panel 30 over a wider range of azimuths.

Figure 7:
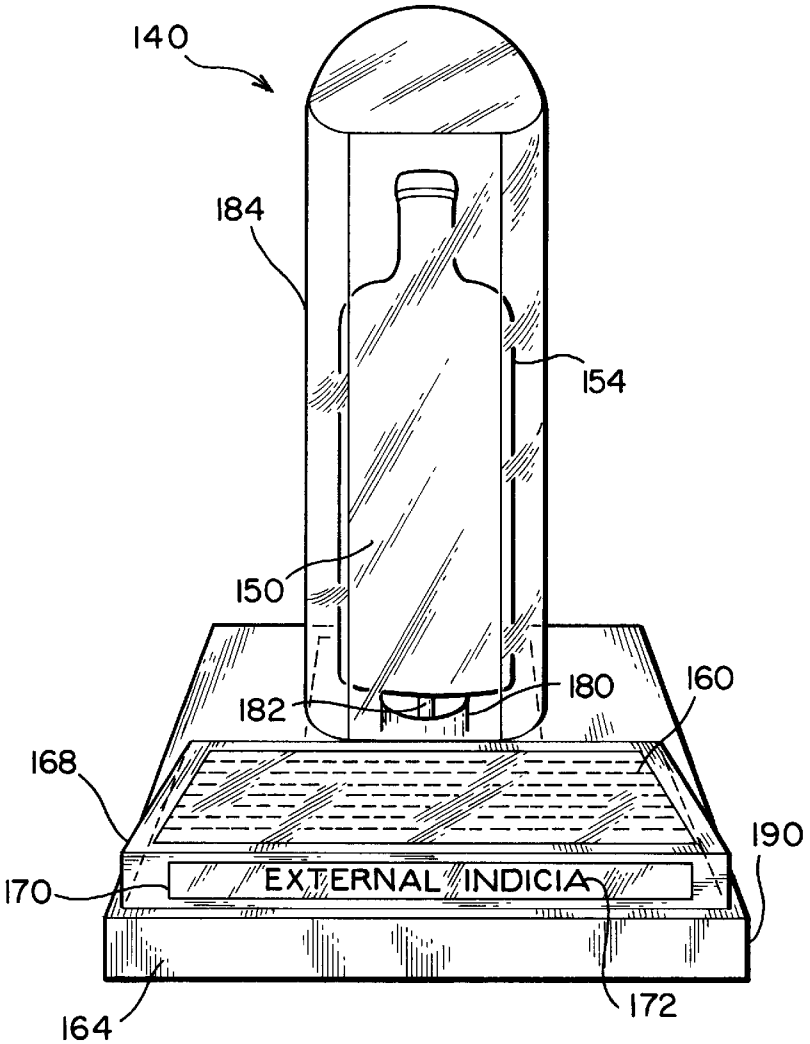
FIG. 7 is a front perspective view of another embodiment of the rotating display.

Another embodiment of the present invention comprises a display 140 as illustrated in FIG. 7. A pictorial work 150 is rendered on a display panel 154 of a selected shape, in this case, a liquor bottle. The pictorial work could be representative of any desirable image, such as the Empire State Building, the Statue of Liberty, a cartoon character, or a commodity for sale in a retail environment. The shape of the panel 154 can be adapted to the shape of the subject represented. In the embodiment of FIG. 7, a plurality of ultraviolet lights 160 are situated proximate to a chosen side 164 of the display. The lights 160 are supported within a shadow box 168 and illuminate the panel 154. A translucent or transparent window 170 can be back lit by the lights 160 for highlighting an external indicia 172. A motor 180 supports and rotates the panel 154 through a lower shaft 182. The panel 154 is situated within a transparent housing 184 which is supported by a housing base 190. In this embodiment, the panel 154 is lit from the chosen side 164 by the lights 160. The rotational orientations of interest for the panel are then oriented toward the chosen side 164 and the display 140 must be aimed so that the chosen side is closest to the viewer.

Figure 8A:
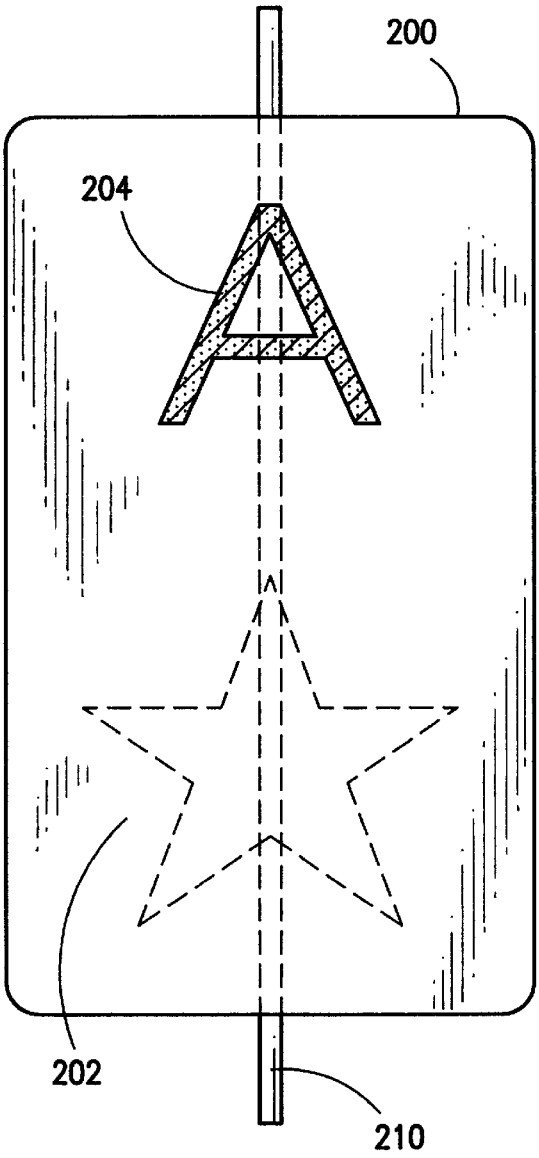
FIGS. 8*a* and 8*b* are front and back views, respectively, of an opaque display panel which may be employed with the embodiments of the present invention.
Figure 8B:
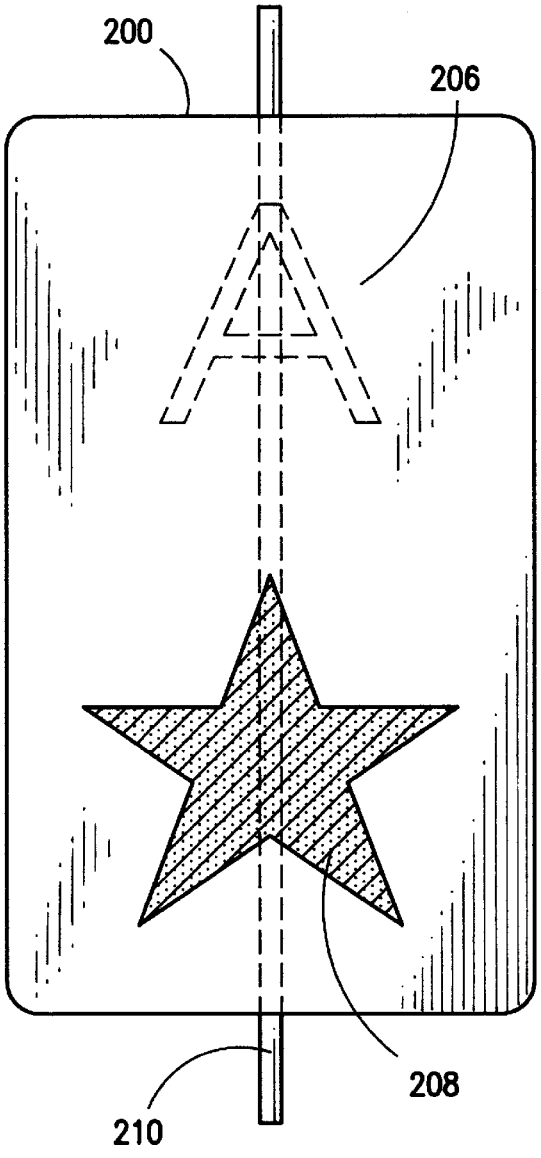

With reference to FIGS. 8*a* and 8*b*, yet another alternative display panel 200 is illustrated which may be employed with the preferred embodiments of the invention. In contrast to the previously described display panels, the display panel 200 is opaque, and includes a front side 202 having a first fluorescent indicia or design 204 disposed thereon, and a back side 206 having a second fluorescent indicia or design 208 disposed thereon. As with the other display panel variations, the display panel 202 also includes a rotatable shaft 210 passing along a central, longitudinal (preferably vertical) axis thereof which permits rotation of the panel 200 by the motor 14 of the embodiment illustrated in FIG. 1*a*, for example, at a speed in the range of approximately 300–3000 rpm.

Figure 9:
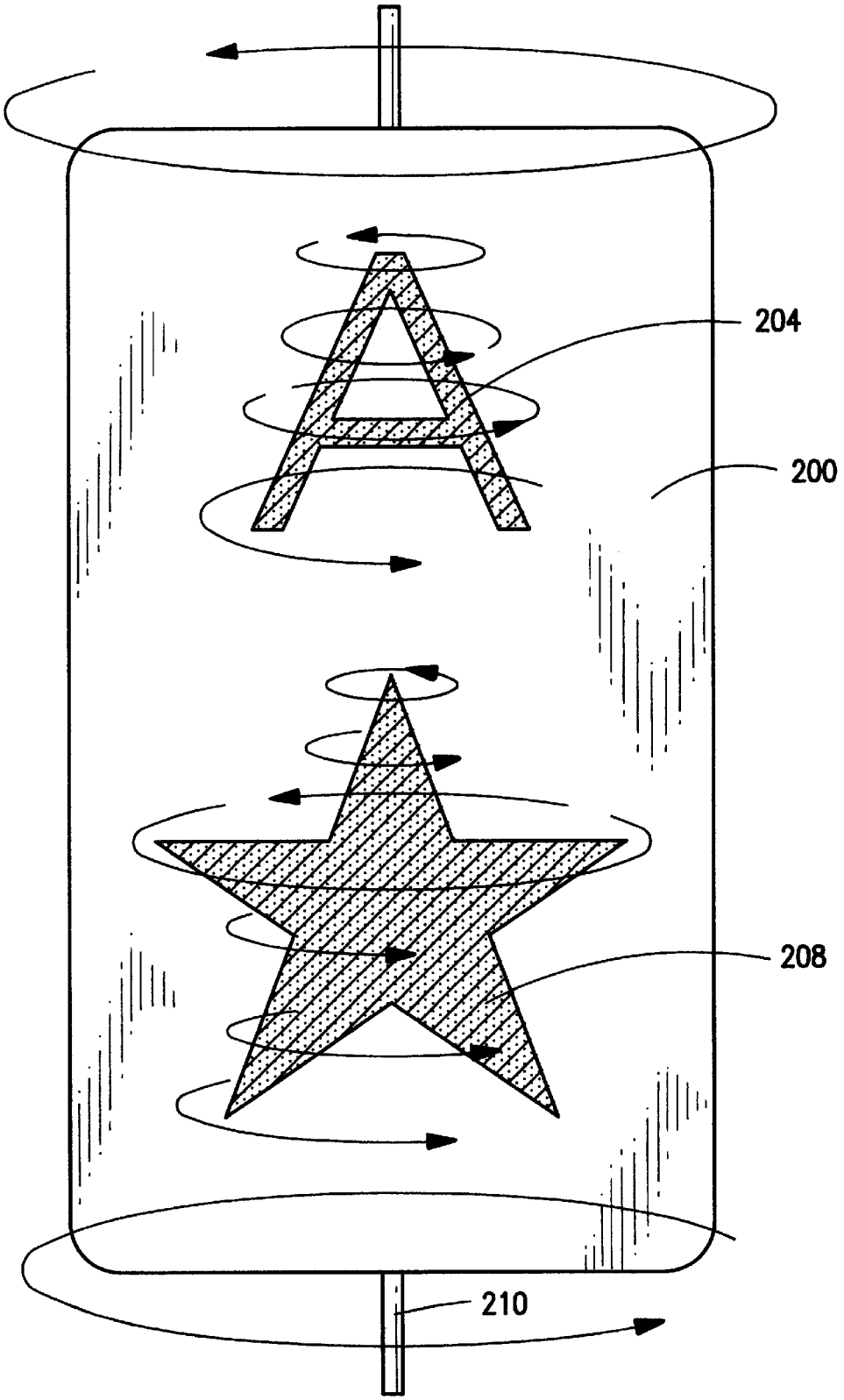
FIG. 9 illustrates the appearance of the panel of FIGS. 8*a* and 8*b* during high speed rotation thereof.

As with the other embodiments of the present invention, when the opaque display panel 200 is rotated at approximately 300 rpm or more, a three-dimensional illusion will be formed as illustrated in FIG. 9, in which both of the indicia or designs 204 and 208 will appear to be combined with one another. However, since each of the indicia or designs 204 and 208 is applied only to one side of the opaque display panel, a flashing effect will occur at slower rotational speeds. This flashing may be a desirable effect, however, it can be eliminated by providing the same indicia on both sides of the display panel 200 as illustrated by the dashed lines in FIGS. 8*a* and 8*b*.

Figure 10:
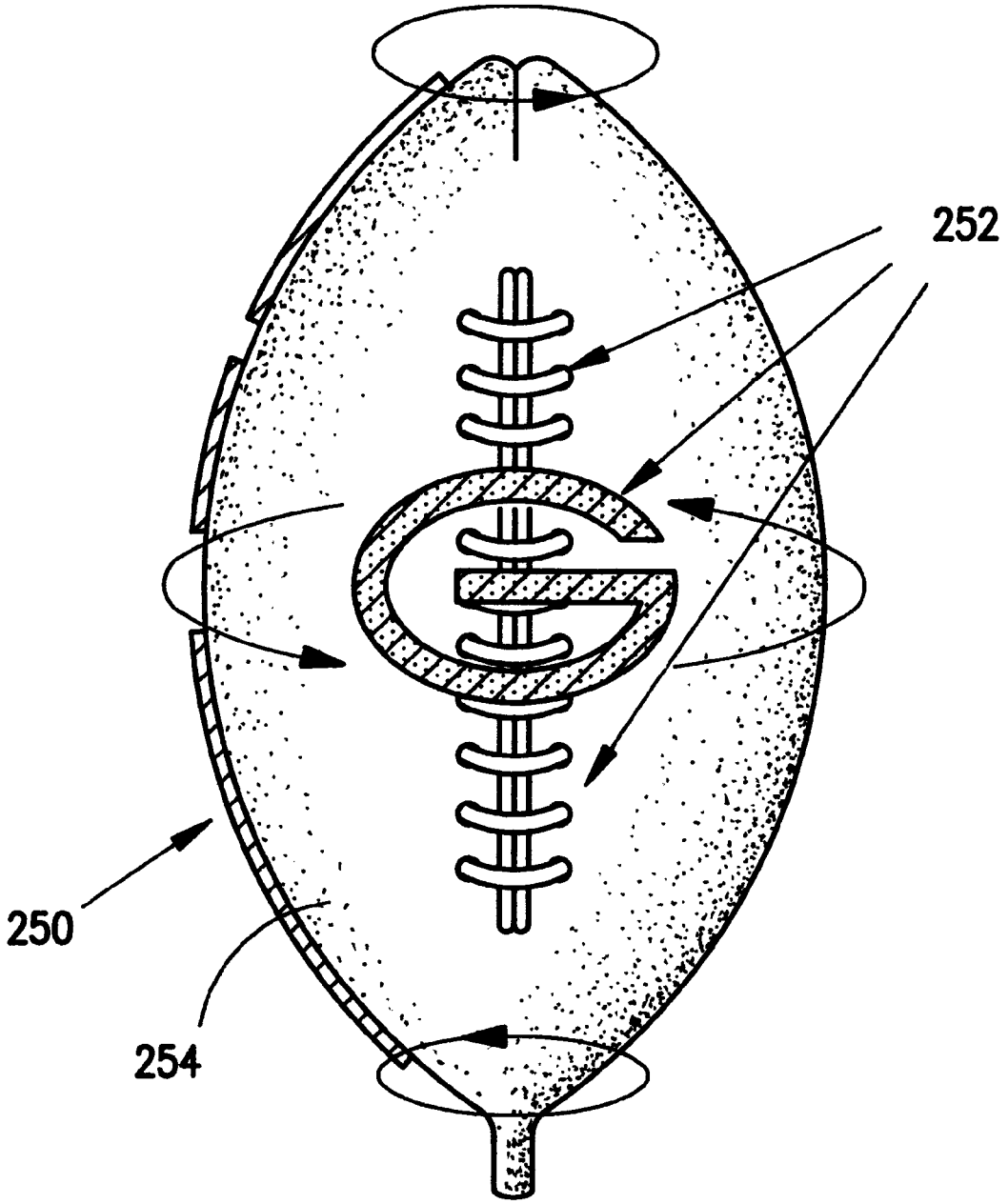
FIG. 10 is a front view of another opaque display panel which may be employed with the preferred embodiments of the present invention.

FIG. 10 illustrates yet another display panel 250 which may be employed with the rotatable display embodiments of the present invention. Preferably, the display panel 250 is generally flat, however, it is formed in the shape of a football with a fluorescent design 252 formed on at least one side 254 thereof. As with the other display panel embodiments, high speed rotation of the display panel 250 during black light illumination results in a three-dimensional effect in which the panel 250 appears to be an actual football, with the fluorescent design 252 being visible from all sides of the display. It should be understood that the football shaped display panel 250 is only one example, and various other shapes can be used to provide the same effect. For example, the display panel 250 can be in the shape of a basketball, baseball, star, doughnut, butterfly, bird, etc. The only requirement in this regard is that the display panel 250 be symmetrical about its central longitudinal axis to provide proper balance during high speed rotation thereof.

Figure 11:
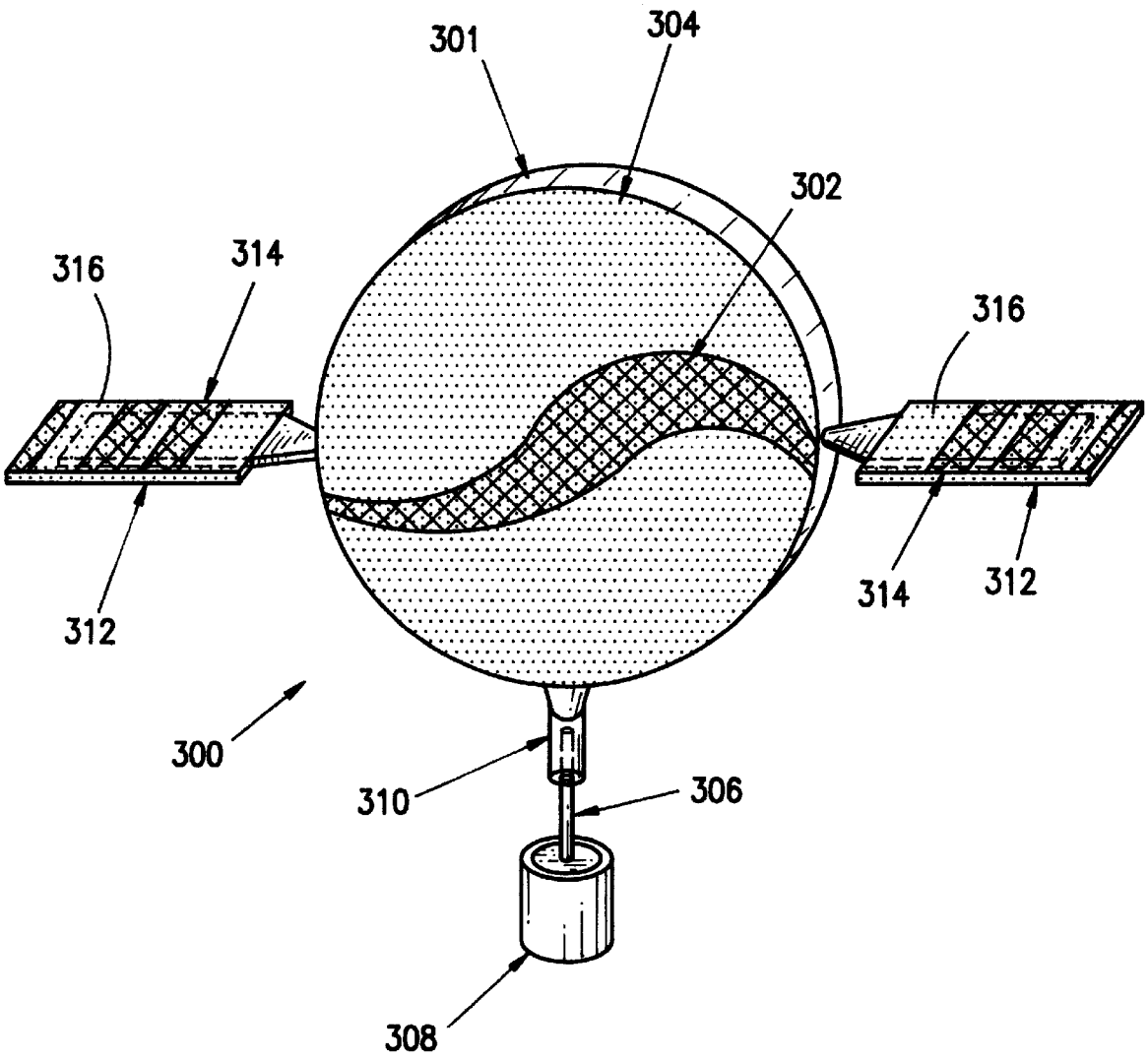
FIG. 11 is a perspective illustration of yet another opaque panel which may be employed with the preferred embodiments of the invention, and includes a pair of wings or blades having fluorescent indicia or designs which provide an additional optical illusion during rotation.

FIG. 11 illustrates yet another embodiment of the present invention comprising a rotatable display 300. The display 300 includes a circular display panel 301 having a fluorescent indicia or design 302 disposed on at least a first side 304 thereof. The display panel 301 is mounted for rotation on a shaft 306 of a high speed motor 308 by means of a shaft connection 310.

Extending from opposite sides of the display panel 301 are first and second generally horizontally positioned blades or wings 312. Each of the blades or wings 312 has a fluorescent indicia or design 314 disposed on at least a first side 316 thereof. Preferably, each of the blades or wings 312 is formed from a flexible, "finger safe" material, such as plastic or foam, so that the display assembly will not pose a safety hazard if it is not contained in a housing. The blades or wings 312 are also preferably flat so that they do not act as fan blades which would require more power to rotate at high speeds. This enables the motor 308 to be battery powered, if desired so that the display 300 is portable.

Figure 12:
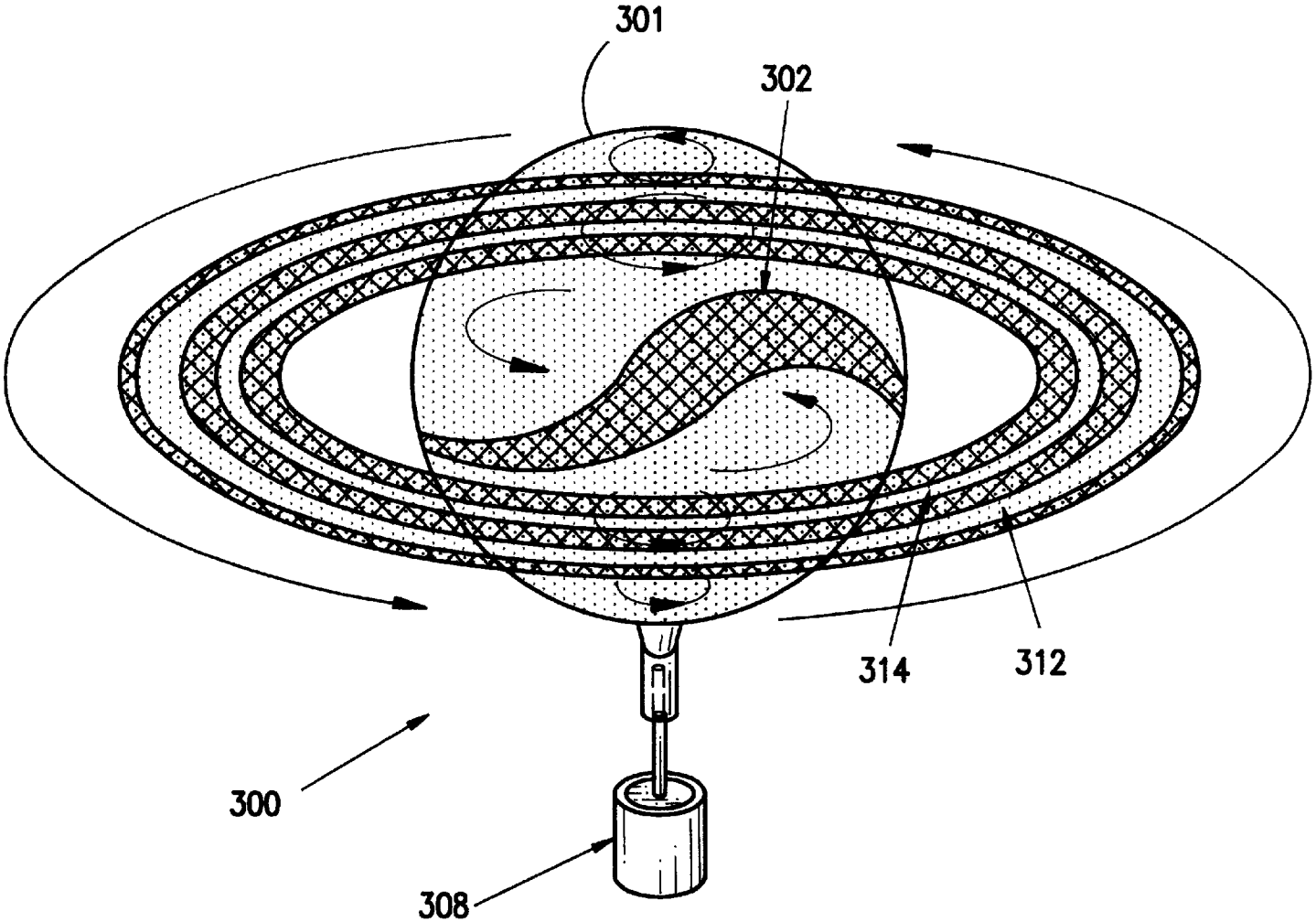
FIG. 12 illustrates the appearance of the display panel of FIG. 11 during high speed rotation thereof.

During rotation of the winged display panel 301 under a black light, a startling three-dimensional illusion is created as illustrated in FIG. 12 in which the circular display panel 301 appears as a sphere, and the fluorescent indicia 314 on the blades 312 appear as rings around the sphere, thus providing an illusion which appears similar to the planet Saturn.

Figure 13:
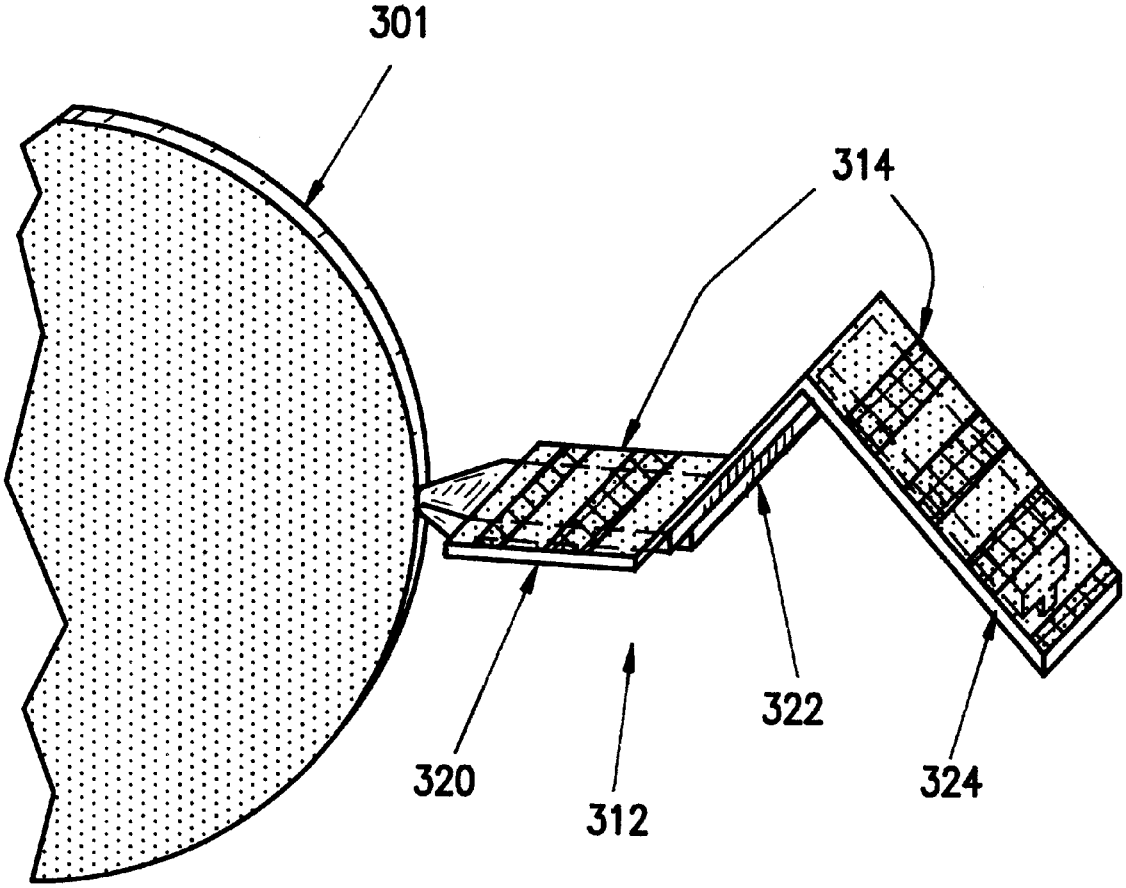
FIG. 13 is a partial perspective view of a variation of the panel of FIG. 11 which employs different shaped wings or blades.

FIG. 13 illustrates a variation of the display 300 in which each of the wings or blades 312 are bent in two places at different angles so that they include a first horizontal section 320, a second section 322 extending in an upward direction, and a third section 324 extending from the end of the second section 322 in a generally downward direction. With this arrangement, when the display panel 301 is rotated at a high speed, the fluorescent indicia 314 on the various sections of the blade or wing 312 will create a whirlpool, vortex or black hole like image, thereby adding depth to the overall optical effect.

In summary, all of the display panel variations, when rotated at high speed and illuminated by a black light, generate optical illusions of three dimensional objects and/or messages hanging in air which may be viewed from a wide range of angular positions.

The foregoing describes the preferred embodiments of the present invention along with a number of possible alternatives. A person of ordinary skill in the art will recognize that additional modifications of the described embodiments may be made without departing from the true spirit and scope of the invention. For example, although the invention is particularly suited for use in retail advertising, it is not limited to such uses and made also be used as a novelty device, decorative art work, etc. The scope of the invention is, therefore, not restricted to the embodiments disclosed above, but is defined in the following claims.

I claim:

1. A display for creating a persistence-of-vision illusion comprising:

a panel having first and second sides and a central longitudinal vertical axis passing along a length of said panel between said first and second sides;

a first fluorescent pattern disposed on said first side of said panel;

an ultraviolet light for illuminating said fluorescent pattern; and a drive mechanism for rotating said panel about said central axis at a speed of at least 300 revolutions per minute; whereby when the display is rotated at a speed of at least 300 revolutions per minute the pattern appears to be hanging motionless and may be viewed from all sides.

2. The display of claim 1, wherein said panel is opaque.

3. The display of claim 2, further including a second fluorescent pattern, said second fluorescent pattern being disposed on said second side of said panel.

4. The display of claim 3, wherein said second fluorescent pattern is different in design from said first fluorescent pattern.

5. The display of claim 3, wherein said second fluorescent pattern is of the same design as that of said first fluorescent pattern.

6. The display of claim 1, wherein said pattern further comprises a message.

7. The display of claim 1, further including first and second blades extending from at least a first edge of said panel, said blades each including a side having at least one fluorescent pattern disposed thereon.

8. The display of claim 7, wherein said side of each of said blades is flat.

9. The display of claim 7, wherein each of said blades includes a plurality of angled sections.

10. The display of claim 7, wherein said panel is circular in shape, and said blades extend horizontally from opposite sides of said panel.

11. The display of claim 7, wherein each of said blades is formed from a flexible material.

12. The display of claim 1, wherein said panel is generally flat, but is shaped like a three dimensional object.

13. The display of claim 12, wherein said object comprises a ball.

14. A method for creating a persistence-of-vision illusion in a display comprising the steps of:

providing a panel having first and second sides, a central longitudinal vertical axis passing along a length of said panel between said first and second sides, and a first fluorescent pattern on one of said sides;

illuminating said fluorescent pattern with ultraviolet light; and rotating said panel about said central axis at a speed of at least 300 revolutions per minute to generate said persistence-of-vision illusion; whereby when the display is rotated at a speed of at least 300 revolutions per minute the pattern appears to be hanging motionless and may be viewed from all sides.

15. The method of claim 14, wherein said method further comprises the step of providing first and second blades extending from at least a first edge of said panel, said blades each including a side having at least a second and a third fluorescent pattern, respectively, disposed thereon.

16. The method of claim 15, wherein each of said blades is selected to be flat.

17. The method of claim 15, wherein said panel is selected to be circular in shape, and said blades extend horizontally from opposite sides of said panel.

18. The method of claim 17, wherein said step of providing a panel further comprises providing a second flourescent pattern disposed on said second side of said panel.

19. The method of claim 18, wherein said second fluorescent pattern is different from said first fluorescent pattern.

20. The method of claim 17, wherein said first flourescent pattern comprises a message.

* * * * *